US007695285B2

(12) United States Patent
Sugiura et al.

(10) Patent No.: US 7,695,285 B2
(45) Date of Patent: Apr. 13, 2010

(54) SPRING CONNECTOR AND CONNECTOR

(75) Inventors: Kenta Sugiura, Arlington Heights, IL (US); Hiroyuki Niibori, Tokyo (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 12/155,110

(22) Filed: May 29, 2008

(65) Prior Publication Data

US 2009/0298354 A1 Dec. 3, 2009

(51) Int. Cl.
*H01R 12/00* (2006.01)

(52) U.S. Cl. ..... 439/66; 439/824

(58) Field of Classification Search ..... 439/66, 439/78, 83, 700, 824
See application file for complete search history.

(56) References Cited

U.S. PATENT DOCUMENTS 2,724,096 A * 11/1955 Klostermann ..... 438/824
6,951,489 B2 * 10/2005 Sekiguchi ..... 439/700

FOREIGN PATENT DOCUMENTS

JP 2003-217726 7/2003

* cited by examiner

*Primary Examiner*—Khiem Nguyen
(74) *Attorney, Agent, or Firm*—Morgan, Lewis & Bockius LLP

(57) ABSTRACT

A spring connector, includes: an electrically conductive metal tube, having a bottomed hole; a plunger, which is provided in the bottomed hole so as to freely move in an axial direction and so as not to slip out from the bottomed hole, and an tip end portion of which is protruded from the bottomed hole; and a spring coil, provided in the bottomed hole, and elastically urging the plunger in a protruding direction. The electrically conductive metal tube includes a small diameter tube part having a smaller outer diameter at a distal end side thereof from which the plunger protrudes, and a soldering part being larger than the small diameter tube part in width in a direction perpendicular to the axial direction, at a backward side of the small diameter tube part in the axial direction, and a face of a distal end side of the small diameter tube part is separated from the soldering part in the direction perpendicular to the axial direction.

7 Claims, 5 Drawing Sheets

SPRING CONNECTOR AND CONNECTOR

BACKGROUND

The present invention relates to a spring connector mounted on and soldered to a board, or a connector configured by mounting a spring connector onto a board by soldering, in which a distal end of an electrically conductive metal tube can be positioned at sufficiently low level on the surface of the board, e.g. the same height as a surface of the board.

Referring to FIG. 9, a structure of a connector in the related art in which a spring connector is mounted on a board will be described. FIG. 9 is a vertical sectional view of the connector in the related art. In FIG. 9, an electrically conductive metal tube 10 is formed by providing a bottomed hole 10*a* in electrically conductive metal material. Moreover, a small diameter tube part 10*c* having a smaller outer diameter is formed at a distal end side of the conductive metal tube 10 near an opening 10*b* of the bottomed hole 10*a*, and a large diameter tube part 10*d* having a larger outer diameter is formed at a backward end side thereof. A spring coil 12 and further, a plunger 14 are inserted into the bottomed hole 10*a*. Then, the opening 10*b* of the bottomed hole 10*a* is narrowed by caulking, so that the plunger 14 can freely move in an axial direction but may not slip out, in a state where its tip end portion is protruded from the opening 10*b*. In this state, the spring coil 12 is contracted, and the plunger 14 is elastically urged in a protruding direction. In this manner, the spring connector 16 is constructed. Then, the spring connector 16 is mounted on a surface of a board 18, and a backward end face of the conductive metal tube 10 is soldered to the board 18 as a soldering part, whereby the connector is constructed. In this case, for enabling the conductive metal tube 10 to stand by itself on the surface of the board 18, the large diameter tube part 10*d* is formed so that an area of the backward end face of the tube 10 may be increased. An art employing the connector in this related art is disclosed in JP-A-2003-217726.

In the connector of the related art as shown in FIG. 9, a height h1 from the surface of the board 18 to the distal end of the conductive metal tube 10 is large. Therefore, a connector in the related art as shown in FIG. 10 has been proposed, as an art for making the height smaller. FIG. 10 is a vertical sectional view of the connector in the related art. In describing the connector in the related art referring to FIG. 10, the same or substantially the same members as the members as shown in FIG. 9 will be denoted with the same reference numerals, and overlapped description will be omitted. The connector in the related art as shown in FIG. 10 is different from the connector in the related art as shown in FIG. 9 in the following points. To begin with, a backward end part of the large diameter tube part 10*d* at the backward end side of the conductive metal tube 10 has a reduced outer diameter, and a flange-like portion 10*e* is formed at an intermediate position in the axial direction. The board 18 is provided with a through hole 18*a* which has such a diameter that the reduced outer diameter portion at the backward end side of the conductive metal tube 10 is allowed to be inserted, but the flange-like portion 10*e* is not allowed to pass. Moreover, an electrically conductive metal foil or the like is applied to an inner peripheral wall of the through hole 18*a* of the board 18, so that the solder in a molten state may easily enter into a gap between the through hole 18*a* and an outer peripheral face of the conductive metal tube 10 by capillary phenomenon. The backward end part of the conductive metal tube 10 having the reduced outer diameter is inserted into the through hole 18*a* of the board 18 from a front face side, and the flange-like portion 10*e* is fixed by soldering to the surface of the board 18, whereby the connector is constructed.

In the connector of the related art as shown in FIG. 10, a height h2 of the distal end of the conductive metal tube 10 projected from the surface of the board 18 is made smaller by an amount of the backward end part of the conductive metal tube 10 inserted into the through hole 18*a* of the board 18. As the results, the height h2 can be made considerably smaller than the height h1 of the distal end of the conductive metal tube 10 from the surface of the board 18 in the connector of the related art as shown in FIG. 9. However, since, in some cases, the related art as shown in FIG. 10 does not sufficiently satisfy a recent demand of further down sizing of electronic apparatuses, it has been required that the height of the distal end of the conductive metal tube 10 from the surface of the board is made further smaller.

SUMMARY

It is therefore an object of the invention is to provide a spring connector and a connector in which a height of a distal end of an electrically conductive metal tube from a surface of a board can be made further smaller.

In order to achieve the object, according to the invention, there is provided a spring connector, comprising:

an electrically conductive metal tube, having a bottomed hole;

a plunger, which is provided in the bottomed hole so as to freely move in an axial direction and so as not to slip out from the bottomed hole, and an tip end portion of which is protruded from the bottomed hole; and a spring coil, provided in the bottomed hole, and elastically urging the plunger in a protruding direction, wherein the electrically conductive metal tube includes a small diameter tube part having a smaller outer diameter at a distal end side thereof from which the plunger protrudes, and a soldering part being larger than the small diameter tube part in width in a direction perpendicular to the axial direction, at a backward side of the small diameter tube part in the axial direction, and a face of a distal end side of the small diameter tube part is separated from the soldering part in the direction perpendicular to the axial direction.

In order to achieve the object, according to the invention, there is also provided a connector, comprising:

the spring connector as claimed in claim 1; and a board, having a surface and a through hole into which the small diameter tube part is inserted from a side of the surface, a gap being between the small diameter tube par which has been inserted into the through hole and an inner face of the through hole, wherein the soldering part is soldered to the surface.

BRIEF DESCRIPTION OF THE DRAWINGS

FIG. 1A is a front view, FIG. 1B is a vertical sectional view, and FIG. 1C is a perspective view showing an outside appearance.

FIG. 3A is a perspective view as seen from a front face side of the board, and FIG. 3B is a perspective view as seen from a back face side.

FIG. 5A is a front view, FIG. 5B is a side view, and FIG. 5C is a bottom view.

FIG. 8A is a perspective view as seen from a front face side of the board, and FIG. 8B is a perspective view as seen from a back face side.

DESCRIPTION OF EXEMPLARY EMBODIMENTS

Now, a first embodiment of the invention will be described referring to FIGS. 1A to 3B.

Figure 9:
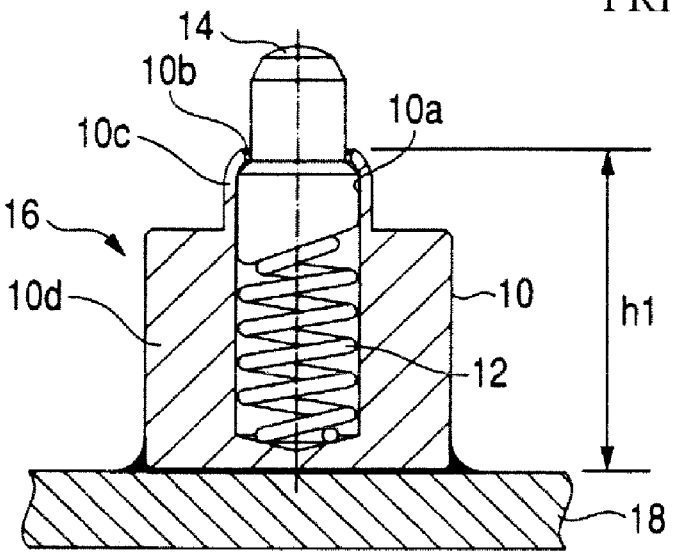
FIG. 9 PRIOR ART
FIG. 9 is a vertical sectional view of a connector in the related art.

In FIGS. 1A to 3B, a spring connector 20 of the connector in the first embodiment of the invention includes an electrically conductive metal tube 10 provided by forming a bottomed hole 10*a* in electrically conductive metal material, in the same manner as the connector in the related art as shown in FIG. 9. The conductive metal tube 10 has a small diameter tube part 10*c* having a smaller outer diameter at a distal end side near an opening 10*b* of the bottomed hole 10*a*, and a large diameter tube part 10*d* having a larger outer diameter at a backward end side.

A spring coil 12 and an electrically conductive plunger 14 are inserted into this bottomed hole 10*a*. The opening 10*b* of the bottomed hole 10*a* is narrowed by caulking, whereby the plunger 14 which can freely move in an axial direction inside the bottomed hole 10*a* is retained so as not to slip out from the bottomed hole 10*a*, in a state where its tip end portion is protruded from the opening 10*b*. In this state, the spring coil 12 is contracted, and the plunger 14 is elastically urged in a protruding direction. Further, in the first embodiment, a groove 10*f* having a depth in the axial direction is formed so as to enclose the small diameter tube part 10*c*, at a position where a distal end side of the large diameter tube part 10*d* ranges to the small diameter tube part 10*c*. In this manner, the spring connector 20 according to the first embodiment is constructed. Moreover, the groove 10*f* may have such a sectional shape that the groove is open at its distal end side and two corners are formed inside, in a U-shape in which the two corners are chamfered, in a V-shape having one corner inside, or the like. The board 18 is provided with a through hole 18*b* having a larger diameter than the small diameter tube part 10*c*. This through hole 18*b* is so constructed that when the small diameter tube part 10*c* is inserted, a gap is formed between an inner periphery of the through hole 18*b* and an outer periphery of the small diameter tube part 10*c*. This gap is set to have such a size that capillary phenomenon may not be exerted on the solder in a molten state. The spring connector 20 is mounted on the board 18 by inserting the small diameter tube part 10*c* into the through hole 18*b* from a back face side, leaving the gap, and by soldering the face at the distal end side of the large diameter tube part 10*d* of the conductive metal tube 10, as a soldering part, to the back face of the board 18 with soldering reflow or the like. In this manner, the connector is constructed.

In the connector in the first embodiment having the above described structure, the spring connector 20 is arranged on the back face of the board 18, and the distal end of the conductive metal tube 10 is exposed from the through hole 18*b* on the front surface of the board 18. Therefore, the distal end of the conductive metal tube 10 is at the substantially same height as the surface of the board 18. In short, the height of the distal end of the conductive metal tube 10 from the surface of the board 18 can be made substantially zero. As the results, as compared with the connectors in the related art, the height of the distal end of the conductive metal tube 10 from the surface of the board 18 can be remarkably reduced. Moreover, because the groove 10*f* is provided so as to enclose the small diameter tube part 10*c*, the solder in a molten state for soldering the face of the distal end side of the large diameter tube part 10*d* to the back face of the board 18 is stored in the groove 10*f* and prevented from flowing, even though the solder flows toward the small diameter tube part 10*c*. Further, even in case where the solder has flowed up to a base part of the small diameter tube part 10*c*, the solder will not move along the outer wall of the small diameter tube part 10*c* up to the distal end side thereof, because the size of the gap is formed so that the capillary phenomenon will not occur between the small diameter tube part 10*c* and the through hole 18*b*. As the results, there is no anxiety that the solder may adhere to a part of the plunger 14 which is protruded from the small diameter tube part l0*c*. Further, in case where the groove 10*f* has such a sectional shape that the groove is open at its distal end side and two corners are formed inside, the solder is respectively collected in the two corner parts, whereby the flow of the solder can be reliably blocked. It is to be noted that the spring connector 20 to be provided on the back face of the board 18 may be arranged in such a manner that the height of the distal end of the conductive metal tube 10 from the surface of the board 18 is made very small, by projecting the distal end of the conductive metal tube 10 only slightly from the surface of the board through the through hole 18*b*.

Figure 1A:
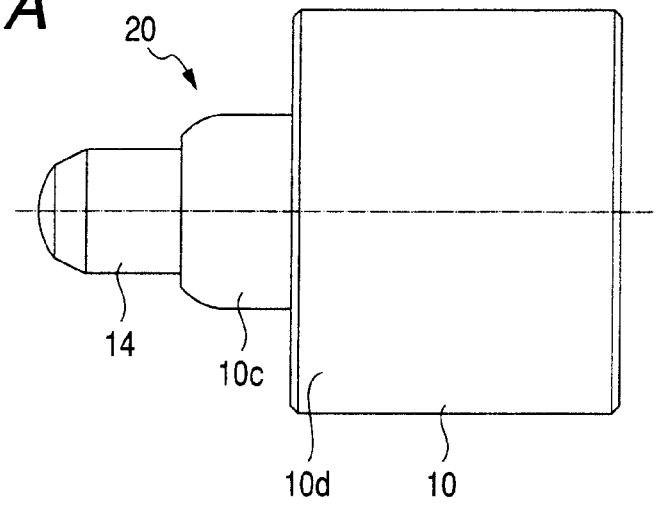
FIGS. 1A, 1B and 1C show a spring connector of a connector in a first embodiment of the invention.
Figure 1B:
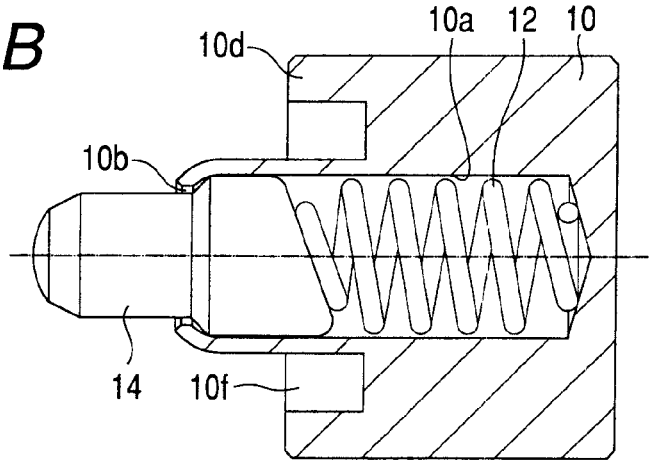
Figure 1C:
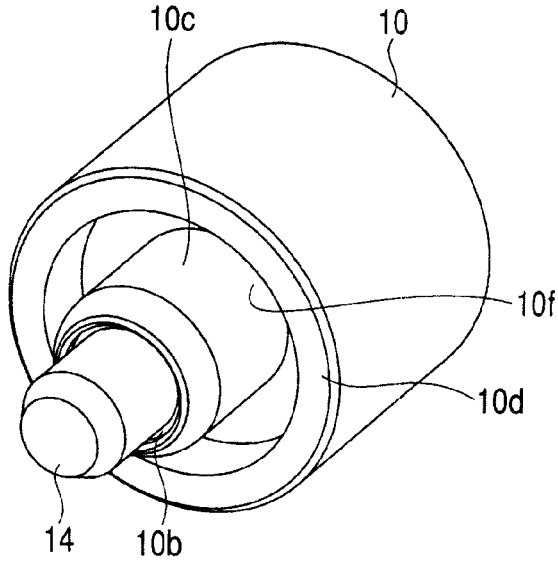
Figure 2:
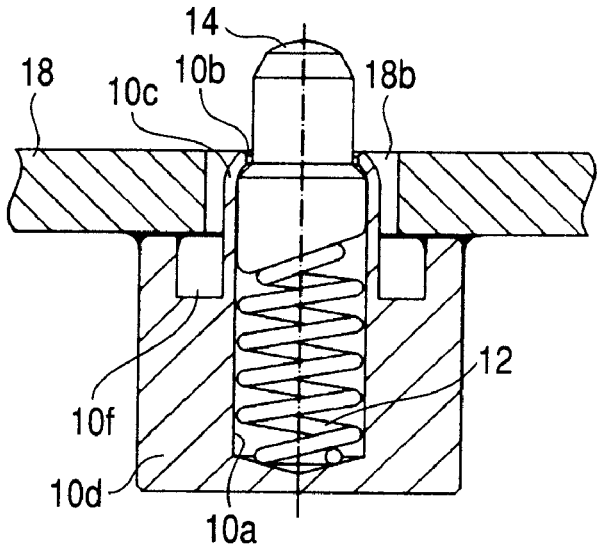
FIG. 2 is a vertical sectional view of the connector in the first embodiment of the invention, in which the spring connector in FIG. 1 is mounted on a board.
Figure 3A:
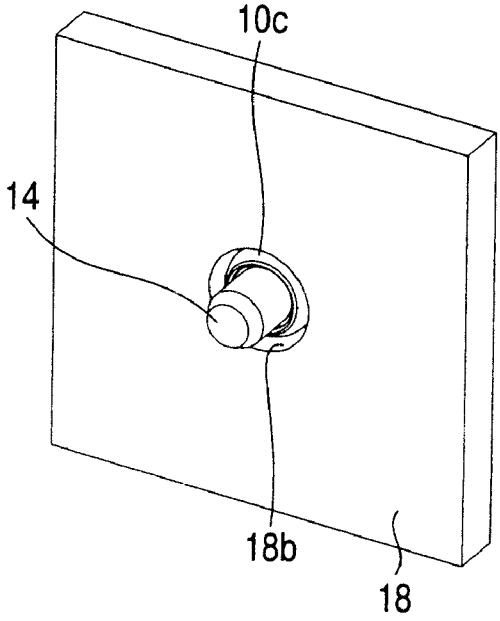
FIGS. 3A and 3B are perspective views showing an outside appearance of the connector in the first embodiment of the invention.
Figure 3B:
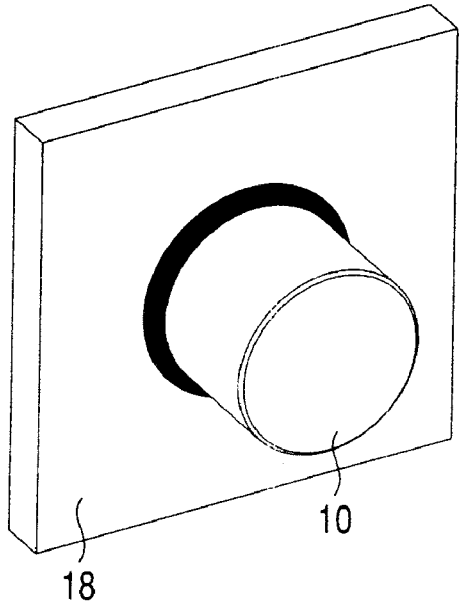
Figure 4:
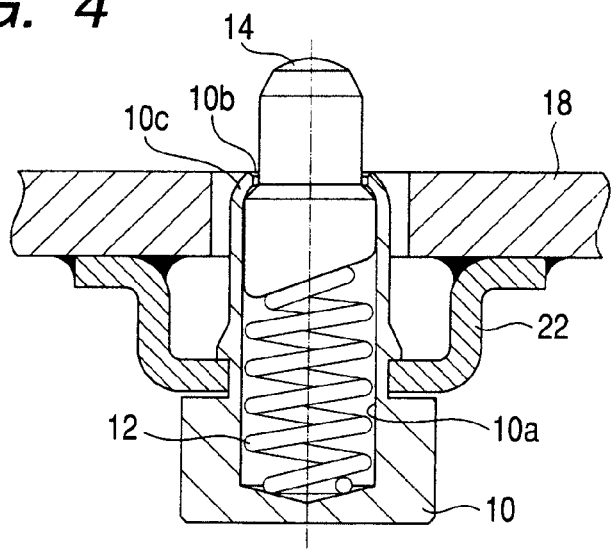
FIG. 4 is a vertical sectional view of a connector in a second embodiment of the invention.
Figure 5A:
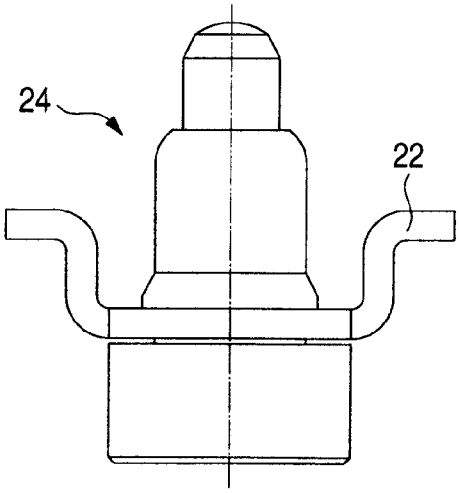
FIGS. 5A, 5B and 5C show a spring connector of a connector in a second embodiment of the invention.
Figure 5B:
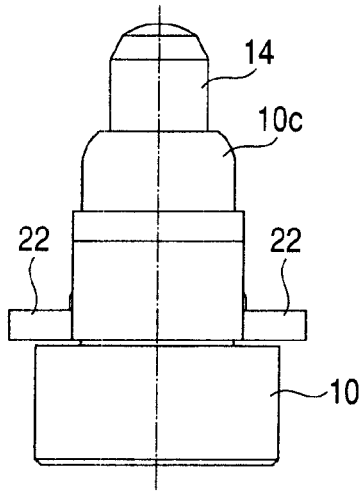
Figure 5C:
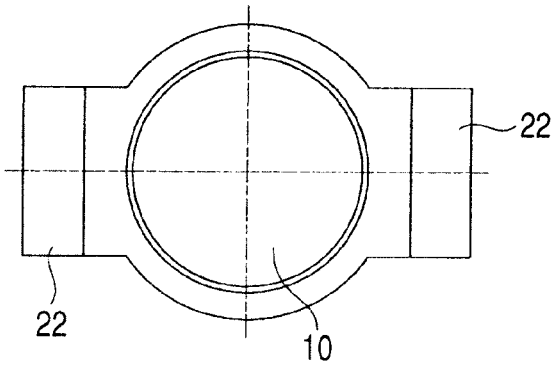
Figure 6:
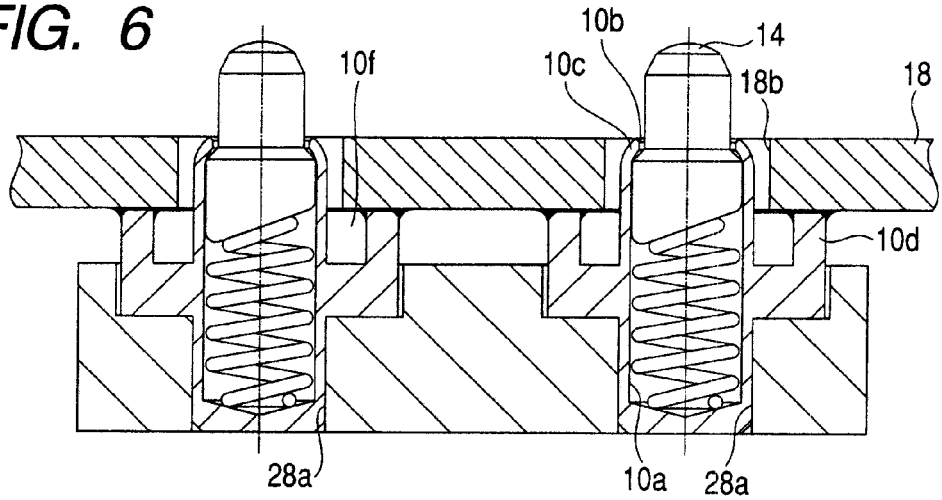
FIG. 6 is a vertical sectional view of a connector in a third embodiment of the invention.
Figure 7:
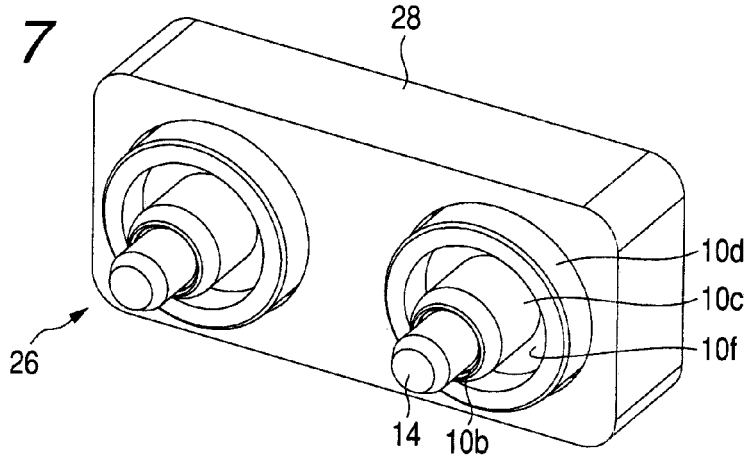
FIG. 7 is a perspective view showing an outside appearance of spring connectors of the connector in the third embodiment of the invention.
Figure 8A:
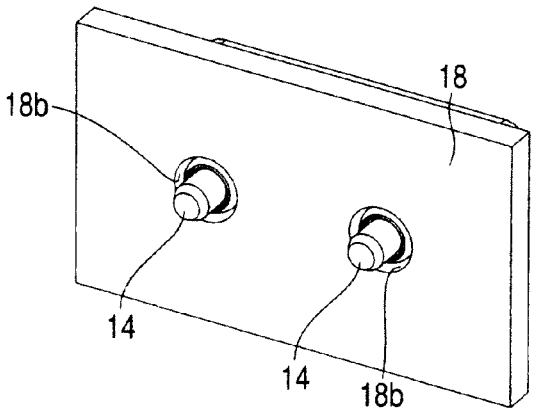
FIGS. 8A and 8B are perspective views showing an outside appearance of the connector in the third embodiment of the invention.
Figure 8B:
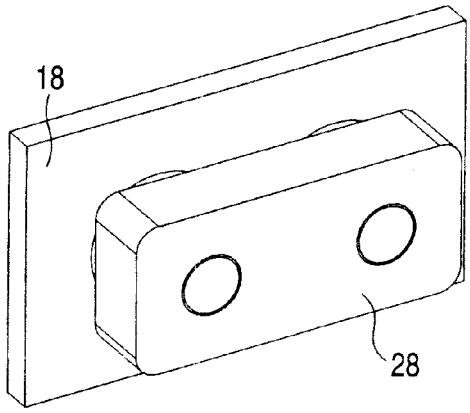
Figure 10:
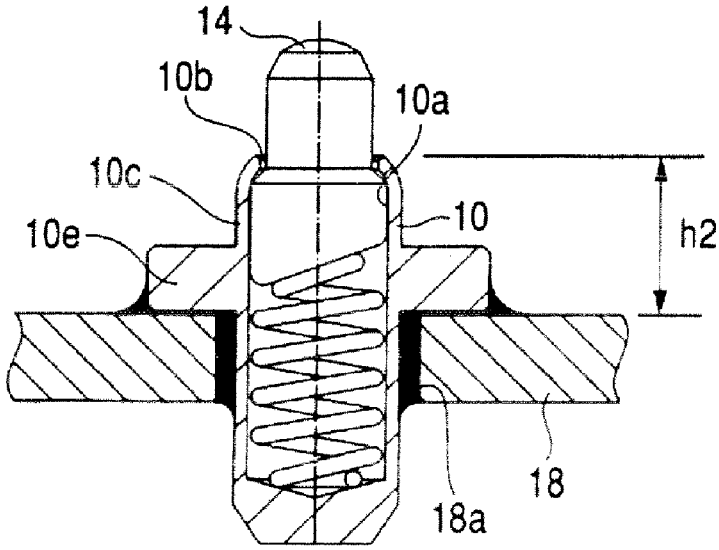
FIG. 10 PRIOR ART
FIG. 10 is a vertical sectional view of a connector in the related art.

Then, a second embodiment of the invention will be described referring to FIGS. 4 to 5C. In FIGS. 4 to 5C, the same and substantially the same members as those members in FIGS. 1A to 3B and in FIGS. 9 and 10 will be denoted with the same reference numerals, and overlapped description will be omitted.

In a spring connector 24 of the connector in the second embodiment of the invention shown in FIGS. 4 to 5C, an electrically conductive metal plate 22 is arranged and fixed on a plane perpendicular to the axial direction by appropriate means such as press-fitting, at an intermediate position of the conductive metal tube 10 located at a backward end side of the small diameter tube part 10*c* in the axial direction. It is apparent that this conductive metal plate 22 is electrically conductive to the conductive metal tube 10. This conductive metal plate 22, which is provided at both sides of the part fixed to the conductive metal tube 10, is folded toward the distal end side in the axial direction at a position apart from the outer periphery of the small diameter tube part 10*c*. Tip end portions of the conductive metal plate 22 which have been folded are further folded so as to extend away from the outer periphery of the small diameter tube part 10*c* in a direction perpendicular to the axial direction thereby to serve as the soldering parts. These soldering parts are provided at a position not going over the opening 10*b* of the small diameter tube part 10*c* toward the distal end side in the axial direction. In this manner, the spring connector 24 in the second embodiment is constructed. Then, the spring connector 24 is mounted on the board 18 by inserting the small diameter tube part 10*c* into the through hole 18*b* from the back face side, leaving a gap, and the soldering parts at the both end sides of the conductive metal part 22 are soldered to the back face of the board 18. In this manner, the connector is constructed.

In the second embodiment having the above described structure, the parts of the conductive metal plate 22 to be soldered to the back face of the board 18 are arranged in a state apart from the small diameter tube part 10*c* in the direction perpendicular to the axial direction. Therefore, the solder for soldering will not flow toward the small diameter tube part 10*c*. Moreover, by appropriately setting a shape and a size of the folded parts of the conductive metal plate 22, it is possible to solder the conductive metal plate 22 to a desired position on the back face of the board 18, and extremely large flexibility in designing can be obtained.

Then, a third embodiment of the invention will be described referring to FIGS. 6 to 8B. In FIGS. 6 to 8B, the same and substantially the same members as those members in FIGS. 1A to 5C and in FIGS. 9 and 10 will be denoted with the same reference numerals, and overlapped description will be omitted.

In FIGS. 6 to 8B, in a spring connector 26 of the connector in the third embodiment of the invention, an outer diameter of the conductive metal tube 10 at its backward end side is made smaller than the conductive metal tube 10 in the first embodiment. A housing 28 formed of insulating resin material is provided with a plurality of insertion holes 28*a* into which the smaller backward end portions of the conductive metal tubes 10 are inserted to be engaged. Moreover, the board 18 is provided with a plurality of through holes 18*b*. It is apparent that the through holes 18*b* respectively correspond to a plurality of the insertion holes 28*a*. By respectively inserting the smaller backward end portions of the conductive metal tubes 10 into the insertion holes 28*a*, a plurality of the spring connectors 26 are positioned. Then, the small diameter tube parts 10*c* of these spring connectors 26 which have been positioned are inserted into the through holes 18*b* of the board 18 from the back face side at a time, and soldering parts at the distal end faces of the large diameter tube parts 10*d* are soldered to the back face of the board 18. In this manner, the connector is constructed.

In the third embodiment having the above described structure, it is possible to mount a plurality of the spring connectors 26 on the board 18 at the same time. Therefore, work is easily performed, as compared with works for mounting a plurality of the spring connectors 26 separately on the board 18, and the connector can be easily produced in addition, because the spring connectors 26 can be accurately positioned by means of the housing, this embodiment can be favorably applied to the connectors arranged with a small pitch.

In the above described embodiments, it would be sufficient that the bottomed hole 10*a* is formed so that the spring coil 12 may be prevented from slipping out to the backward end side, and therefore, the bottomed hole 10*a* may be formed in such a manner that a hole which is open at its backward end side is closed or narrowed by caulking, after once the hole has been formed in a conductive metal tube 10. Moreover, although it is described in the second embodiment that the conductive metal plate 22 is fixed to the conductive metal tube 10 by press-fitting, the invention is not limited to the case, but the conductive metal plate 22 may be fixed by soldering or the like. Further, the shape of this conductive metal plate 22 is not limited to the shape in the second embodiment, but may be in a round shape as seen in the axial direction. Still further, although the conductive metal tube 10 has the smaller diameter at the backward end side in the third embodiment, it is unnecessary to make the backward end side of the conductive metal tube 10 smaller, provided that an insertion length of the conductive metal into the housing 28 can be restricted by some other means.

According to an aspect of the invention, because the spring connector is provided by soldering it to the back face of the board, and the distal end portion of the conductive metal tube is exposed from the through hole which is formed in the board, the height of the distal end of the conductive metal tube from the surface of the board can be made zero or sufficiently small. In addition, because the part to be soldered to the back face of the board is separated from the small diameter tube part, and the gap is formed between the through hole of the board and the small diameter tube part which has been inserted therein, the solder in the soldering part in a molten state will not flow to the small diameter tube part, and will not adhere to the plunger.

According to an aspect of the invention, the groove is formed so as to enclose the small diameter tube part, at the position where the large diameter tube part provided at the backward end side of the conductive metal tube ranges to the small diameter tube part provided at the distal end side thereof. Therefore, this groove reliably prevents the solder in the soldering part on the face of the distal end side of the large diameter tube part from flowing to the small diameter tube part.

According to an aspect of the invention, because the soldering parts are provided by employing the conductive metal plate, it is possible to freely set the positions to be soldered on the back face of the board, by designing the folded shape of the conductive metal plate.

According to an aspect of the invention, because the spring connector is provided by soldering it to the back face of the board, and the distal end portion of the conductive metal tube is exposed from the through hole which is formed in the board, the height of the distal end of the conductive metal tube from the surface of the board can be made zero or sufficiently small. In addition, because the soldering part to be soldered to the back face of the board is separated from the small diameter tube part, and the gap is formed between the through hole of the board and the small diameter tube part which has been inserted therein, the solder in the soldering part in a molten state will not flow to the small diameter tube part, and will not adhere to the plunger.

According to an aspect of the invention, a plurality of the spring connectors can be positioned by inserting the back end portions of the conductive metal tubes into the insertion holes of the housing, and it is possible to arrange a plurality of the spring connectors on one sheet of the board at the same time. As the results, the connector provided with a plurality of the spring connectors can be easily produced.

What is claimed is:

1. A spring connector, comprising:

an electrically conductive metal tube, having a bottomed hole;

a plunger, which is provided in the bottomed hole so as to freely move in an axial direction and so as not to slip out from the bottomed hole, and an tip end portion of which is protruded from the bottomed hole; and a spring coil, provided in the bottomed hole, and elastically urging the plunger in a protruding direction, wherein the electrically conductive metal tube includes a small diameter tube part having a smaller outer diameter at a distal end side thereof from which the plunger protrudes, a soldering part being larger than the small diameter tube part in width in a direction perpendicular to the axial direction is provided at a backward side of the small diameter tube part in the axial direction, a soldering part faces in a direction in which the plunger protrudes, and a face of a distal end side of the small diameter tube part is separated from the soldering part in the direction perpendicular to the axial direction.

2. The spring connector as claimed in claim 1, wherein the electrically conductive metal tube includes a large diameter tube part having a larger outer diameter than the small diameter tube part at a backward side of the small diameter tube part in the axial direction, and a groove having a depth in the axial direction and enclosing the small diameter tube part at a position where the small diameter tube part ranges to the large diameter tube part, and a face of a distal end side of the large diameter tube part serves as the soldering part.

3. The spring connector as claimed in claim 1, wherein the electrically conductive tube part is provided with an electrically conductive metal plate being larger than the small diameter tube part in width in the direction perpendicular to the axial direction, at a backward side of the small diameter tube part in the axial direction, and a part of the electrically conductive metal plate serves as the soldering part.

4. A connector, comprising:

a spring connector including:

an electrically conductive metal tube, having a bottomed hole;

a plunger, which is provided in the bottomed hole so as to freely move in an axial direction and so as not to slip out from the bottomed hole, and an tip end portion of which is protruded from the bottomed hole; and a spring coil, provided in the bottomed hole, and elastically urging the plunger in a protruding direction, wherein the electrically conductive metal tube includes a small diameter tube part having a smaller outer diameter at a distal end side thereof from which the plunger protrudes, a soldering part being larger than the small diameter tube part in width in a direction perpendicular to the axial direction is provided at a backward side of the small diameter tube part in the axial direction, a face of a distal end side of the small diameter tube part is separated from the soldering part in the direction perpendicular to the axial direction, and a board, having a surface and a through hole into which the small diameter tube part is inserted from a side of the surface, a gap being between the small diameter tube part which has been inserted into the through hole and an inner face of the through hole, wherein the soldering part is soldered to the surface.

5. The connector as claimed in claim 4, further comprising:

a housing, formed of insulating material, and having a plurality of insertion holes, wherein backward portion of the electrically conductive metal tubes of a plurality of the spring connectors are respectively inserted into the plurality of the insertion holes.

6. A spring connector, comprising:

an electrically conductive member, having a first face and a hole extending in a first direction, the first face including a first portion protruding in the first direction and having the hole, a second portion enclosing the first portion and having a shape of groove, and a third portion positioned outside of the second portion in a second direction perpendicular to the first direction; and a pin member, provided in the hole, and contractably projected from the hole.

7. A connector incorporating the spring connector as claimed in claim 6, the connector comprising:

a board, having a surface and a through hole, wherein the first portion of the spring connector is inserted into the through hole from a side of the surface, the third portion of the spring connector is soldered to the surface, and a gap is formed between a periphery of the first portion of the spring connector and an inner face of the through hole.

* * * * *